US009488413B2

(12) United States Patent
Zhang et al.

(10) Patent No.: US 9,488,413 B2
(45) Date of Patent: Nov. 8, 2016

(54) GASIFICATION SYSTEM

(75) Inventors: Jiansheng Zhang, Beijing (CN); Hongbo Ma, Beijing (CN); Dadi Gu, Beijing (CN)

(73) Assignee: TSINGHUA UNIVERSITY & BEIJING TINGDE QINGDA TECHNOLOGY CO., LTD., Beijing (CN)

( * ) Notice: Subject to any disclaimer, the term of this patent is extended or adjusted under 35 U.S.C. 154(b) by 512 days.

(21) Appl. No.: 14/001,642

(22) PCT Filed: Feb. 24, 2011

(86) PCT No.: PCT/CN2011/071278

§ 371 (c)(1),
(2), (4) Date: Oct. 21, 2013

(87) PCT Pub. No.: WO2012/113149

PCT Pub. Date: Aug. 30, 2012

(65) Prior Publication Data

US 2014/0030668 A1 Jan. 30, 2014

(51) Int. Cl.

| | |
|---|---|
| ***F28D 7/10*** | (2006.01) |
| ***F27D 1/12*** | (2006.01) |
| ***C10J 3/52*** | (2006.01) |
| ***C10J 3/76*** | (2006.01) |
| ***C10J 3/84*** | (2006.01) |
| ***C10J 3/48*** | (2006.01) |

(52) U.S. Cl.

CPC ..... *F27D 1/12* (2013.01); *C10J 3/485* (2013.01); *C10J 3/526* (2013.01); *C10J 3/76* (2013.01); *C10J 3/845* (2013.01); *C10J 2300/0933* (2013.01)

(58) Field of Classification Search

CPC ..... F27D 1/12
USPC ..... 432/238; 165/157; 122/7 R
See application file for complete search history.

(56) References Cited

U.S. PATENT DOCUMENTS

2008/0190026 A1* 8/2008 De Jong ..... C01B 3/363 48/205

FOREIGN PATENT DOCUMENTS

| | | | |
|---|---|---|---|
| CN | 2563158 | Y | 7/2003 |
| CN | 2887834 | Y | 4/2007 |
| CN | 101245263 | A | 8/2008 |
| EP | 0079092 | A1 | 5/1983 |
| WO | 2011012232 | A2 | 2/2011 |

OTHER PUBLICATIONS

International Search Report and Written Opinion dated Nov. 17, 2011 for corresponding International Application No. PCT/CN2011/071278, filed Feb. 24, 2011 (24 pages).

* cited by examiner

*Primary Examiner* — Gregory Huson
*Assistant Examiner* — John Bargero
(74) *Attorney, Agent, or Firm* — Mai-Tram D. Lauer; James L. Young; Westman, Champlin & Koehler, P.A.

(57) ABSTRACT

A gasification furnace is provided. The gasification furnace includes an outer shell having an outer shell inlet formed at a top of the outer shell and an outer shell outlet formed at a bottom of the outer shell; an inner shell having an inner shell inlet corresponding to the outer shell inlet, and an inner shell outlet corresponding to the outer shell outlet, and being fabricated by a membrane wall having a cooling water inlet and a cooling water outlet; a nozzle; a lower shell having a slag exhausting port and a gas discharging port; a cooler having a cooling passage formed therein, a cooler water inlet, and a cooler water outlet; a positioning member disposed between the inner shell and an inner bottom wall of the outer shell; and a gas guiding pipe defining an upper end connected with the cooler, and a lower end extended downward.

15 Claims, 4 Drawing Sheets

GASIFICATION SYSTEM

CROSS-REFERENCE TO RELATED APPLICATION

This Application is a Section 371 National Stage Application of International Application No. PCT/CN2011/071278, filed Feb. 24, 2011, and published as WO 2012/113149 on Aug. 30, 2012, in Chinese, the contents of which are hereby incorporated by reference in their entirety.

FIELD

The present invention relates to a gasification furnace, and more particularly to a coal gasification furnace capable of using a coal with a high ash fusion point (FT) as a raw material to produce a crude coal gas containing carbon monoxide and hydrogen.

BACKGROUND

The inner layer of a conventional entrained flow gasification furnace using a coal-water slurry as a raw material is usually formed from a refractory brick, it is required that the ash fusion point (FT) of the coal used as the raw material is not more than 1400 degrees centigrade, thus restricting the choice of the type of the coal. For example, the coal-water slurry gasification furnace of GE requires that the ash fusion point (FT) of the raw material coal is not higher than 1350 degrees centigrade. Accordingly, the conventional gasification furnace limits the use of raw materials, and the cheap coal can not be used widely, so that the application of the conventional gasification furnace is limited. Moreover, the production, mounting, maintenance and replacement of the refractory brick are extremely complex and take much time and effort. In addition, the conventional gasification furnace is poor in cooling effect and high in cost.

SUMMARY

Embodiments of the present invention seek to solve at least one of the problems existing in the related art to at least some extent. Accordingly, an object of the present invention is to provide a gasification furnace, the raw material coal of which may be chosen widely and not be limited by the ash fusion point of the raw material coal so that the cheap coal may be used, and which may be wide in applicability and friendly to the environment.

The gasification furnace according to embodiments of the present invention comprises: an outer shell having an outer shell inlet formed at a top of the outer shell and an outer shell outlet formed at a bottom of the outer shell; an inner shell which is disposed in and spaced apart from the outer shell, defines a gasification chamber therein, has an inner shell inlet corresponding to the outer shell inlet and formed at a top of the inner shell, and an inner shell outlet corresponding to the outer shell outlet formed at a bottom of the inner shell, and is fabricated by a membrane wall having a cooling water inlet and a cooling water outlet; a nozzle disposed at the tops of the outer shell and the inner shell so as to extend into the gasification chamber through the outer shell inlet and the inner shell inlet; a lower shell connected with a lower portion of the outer shell, defining a slag exhausting chamber therein, and having a slag exhausting port formed at a bottom of the lower shell and a gas discharging port formed in an upper portion of a side wall of the lower shell, wherein the gasification chamber is communicated with the slag exhausting chamber via the outer shell outlet and the inner shell outlet; a cooler connected with an outer bottom wall of the outer shell around the outer shell outlet, and having a cooling passage formed therein, a cooler water inlet, and a cooler water outlet; a positioning member disposed between the inner shell and an inner bottom wall of the outer shell; and a gas guiding pipe defining an upper end connected with the cooler, and a lower end extended downward in the slag exhausting chamber, wherein the gas guiding pipe has a cooling water passage formed in a wall of the gas guiding pipe, a water inlet and a water outlet which are communicated with the cooling water passage respectively.

With the gasification furnace according to embodiments of the present invention, since the gasification chamber is defined by the individual inner shell fabricated by the membrane wall, the temperature in the gasification chamber can be improved such that the coal with a high ash fusion point can be used as a raw material to produce a synthetic gas. Moreover, with the gasification furnace according to embodiments of the present invention, the positioning member disposed between the inner bottom wall of the outer shell and the inner shell has an ability of resisting gas erosion better than the refractory brick and is convenient to replace. Furthermore, because the cooler capable of cooling the gas and ash falling from the gasification chamber is disposed, the cooling effect is improved, thus prolonging the service life of the gasification furnace.

In some embodiments, the inner shell comprises: an upper header being annular so as to define the inner shell inlet; a lower header being annular so as to define the inner shell outlet; and a plurality of cooling pipes extended side by side in an up and down direction, in which two ends of each cooling pipe are connected with the upper and lower headers respectively.

With the gasification furnace according embodiments of the present invention, the inner shell is constituted by the upper and lower headers of an annular shape and the plurality of cooling pipes extended side by side in the up and down direction between the upper and lower headers, so that the inner shell is more convenient to manufacture.

In some embodiments, each of the upper and lower headers is configured as an annular pipe. Thus, for example, two ends of each of the plurality of cooling pipes are welded to the upper and lower headers respectively, thus further improving the convenience of the manufacture of the inner shell.

In some embodiments, the cooling water inlet is positioned in a lower portion of the inner shell, and the cooling water outlet is positioned in an upper portion of the inner shell.

With the cooling water inlet located in the lower portion of the inner shell and the cooling water outlet located in the upper portion of the inner shell, the cooling water flows in an opposite direction to the ash, the gas and other solid materials in the inner shell, so that a mixture of water and a steam after heat exchange is move upwards based on the natural circulation principle, thus further improving the effect of cooling the inner shell.

In some embodiments, the outer shell comprises: an upper cover; a lower cover; and a straight cylinder defining two ends connected with the upper cover and the lower cover respectively.

Thus, for example, the upper cover, the lower cover and the straight cylinder can be welded together so as to improve the convenience of the manufacture of the outer shell.

In some embodiments, the lower end of the gas guiding pipe is extended below a liquid level of cooling water in the lower shell. The gas from the gasification chamber enters into the cooling water in the lower shell, then comes out of the cooling water and is discharged from the gas discharging port, thus further lowering the temperature of the gas.

In some embodiments, the cooler is an annular plate and the water outlet is configured as an annular and flat slot extended in a circumferential direction of the annular plate.

A large amount of unmelted slag and unburned coal from the gasification chamber may erode the annular outlet of the cooler when passing through the cooler. Because the water cooler outlet is configured as an annular and flat slot, the shape of the flat water outlet does not change even if the annular outlet is eroded and the pattern of the ejected water does not change either, thus ensuring the normal operation of the gasification furnace.

In some embodiments, the cooler is an annular plate, and an opening direction of the water outlet of the cooler is oriented towards or away from a center axis of the annular plate in a horizontal direction.

Alternatively, the cooler is an annular plate, and an opening direction of the water outlet of the cooler is inclined downward and oriented towards or away from a center axis of the annular plate.

Accordingly, with the gasification furnace according to embodiments of the present invention, the cooling effect can be conveniently adjusted by changing the opening direction of the water cooler outlet.

In some embodiments, the positioning member comprises: an annular trough mounted on the inner bottom wall of the outer shell around the outer shell outlet and defining an annular groove; and an annular insertion plate defining an upper end mounted on an outer bottom wall of the inner shell around the inner shell outlet and a lower end inserted into the annular groove.

The positioning member according to embodiments of the present invention is simple in structure, long in service life and convenient to manufacture and mount.

The gasification furnace according to embodiments of the present invention further comprises a cooling panel having a cooling panel passage, a cooling panel water inlet and a cooling panel water outlet which are communicated with the cooling panel passage respectively, wherein an upper end of the cooling panel is connected with the outer bottom wall of the outer shell the cooling panel is fitted over the gas guiding pipe so as to define a gas discharging space therebetween, and the gas discharging port is communicated with an upper portion of the gas discharging space.

In some embodiments, a lower end of the cooling panel is located below the liquid level of the cooling water in the lower shell, and the lower end of the gas guiding pipe is located above the liquid level of the cooling water in the lower shell.

By disposing the cooling panel and making the lower end of the gas guiding pipe located above the liquid level of the cooling water, the gas produced in the gasification chamber enters into the gas discharging space and the temperature of the gas is lowered, and in the ascending process of the gas, the gas can be further cooled by the cooling panel. In addition, the heat of the gas can be recovered by the cooling panel, thus improving the heat efficiency of the gasification furnace.

The gasification furnace according to embodiments of the present invention further comprises a cooling panel having a cooling panel passage, a cooling panel water inlet and a cooling panel water outlet which are communicated with the cooling panel passage respectively, wherein an upper end of the cooling panel is connected with the outer bottom wall of the outer shell the cooling panel is fitted in the gas guiding pipe so as to define a gas discharging space therebetween, and the gas discharging port is communicated with an upper portion of the gas discharging space.

In some embodiments, a lower end of the cooling panel is located above the liquid level of the cooling water in the lower shell, and the lower end of the gas guiding pipe is located below the liquid level of the cooling water in the lower shell.

By disposing the cooling panel in the gas guiding pipe, the gas discharging port needs not to pass through the cooling panel so that the structure is simple.

In some embodiments, a plurality of the water outlets of the gas guiding pipe are formed in an inner circumferential wall of the gas guiding pipe and distributed in an up and down direction and a circumferential direction of the gas guiding pipe.

With the plurality of water outlets distributed in the up and down direction and the circumferential direction of the gas guiding pipe in the inner circumferential wall of the gas guiding pipe, the cooling effect on the ash, gas and other solid materials is further improved, and the deformation of the gasification furnace is reduced so as to prolong the service life of the gasification furnace.

In some embodiments, the cooler and the gas guiding pipe are integrally formed. Accordingly, the manufacture of the cooler and the gas guiding pipe is simple.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the drawings, in which.

DETAILED DESCRIPTION

Figure 1:
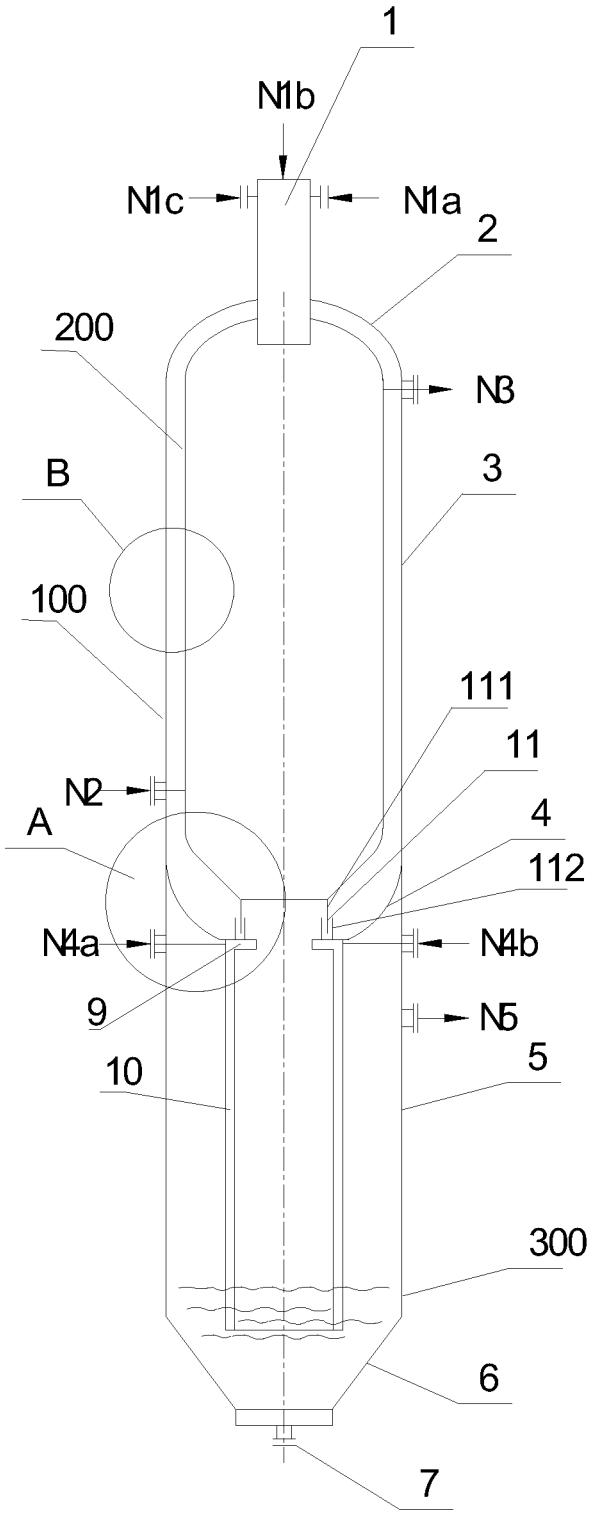
FIG. 1 is a schematic view of a gasification furnace according to an embodiment of the present invention.

Reference will be made in detail to embodiments of the present invention. The embodiments described herein with reference to drawings are explanatory, illustrative, and used to generally understand the present invention. The embodiments shall not be construed to limit the present invention. The same or similar elements and the elements having same or similar functions are denoted by like reference numerals throughout the descriptions.

In the specification, unless specified or limited otherwise, relative terms such as "central," "longitudinal," "lateral," "front," "rear," "right," "left," "inner," "outer," "lower," "upper," "horizontal," "vertical," "above," "below," "up," "top," "bottom" as well as derivative thereof (e.g., "horizontally," "downwardly," "upwardly," etc.) should be construed to refer to the orientation as then described or as shown in the drawings under discussion. These relative terms are for convenience of description and do not require that the present invention be constructed or operated in a particular orientation.

Terms concerning attachments, coupling and the like, such as "mounted," "connected," and "interconnected," refer to a relationship in which structures are secured or attached to one another either directly or indirectly through intervening structures, as well as both movable or rigid attachments or relationships, unless expressly described otherwise.

The gasification furnace according to embodiments of the present invention will be described below with reference to the drawings.

Figure 4:
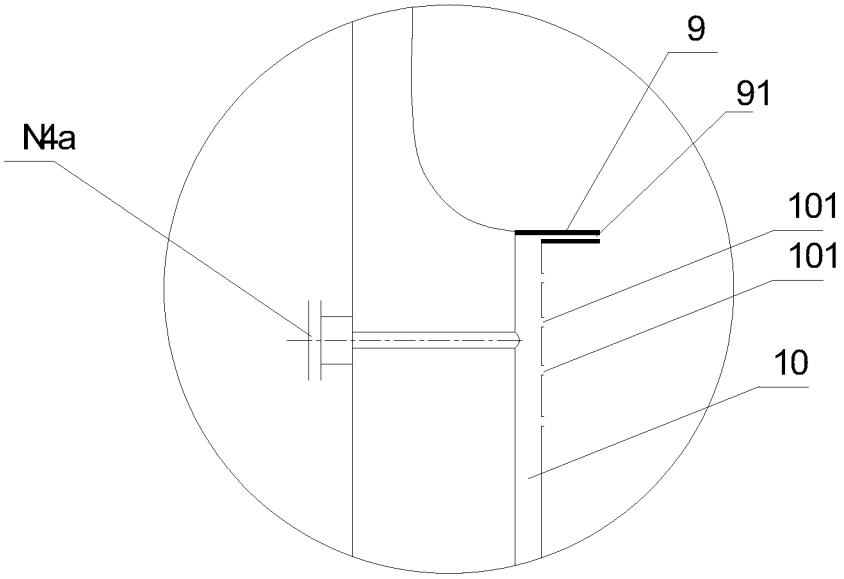
FIG. 4 is a schematic enlarged view of a section shown in a circle A in FIGS. 1-3.
Figure 5:
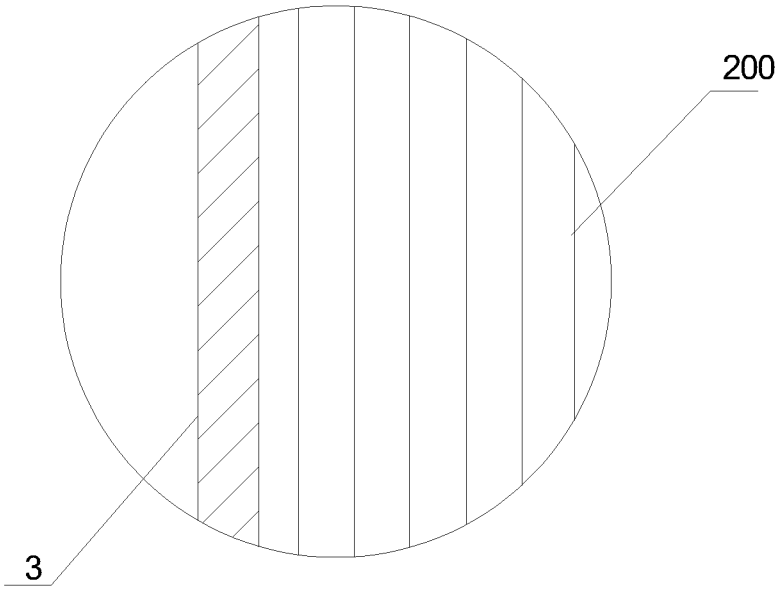
FIG. 5 is a schematic enlarged view of a section shown in a circle B in FIGS. 1-3.

As shown in FIG. 1 and FIGS. 4-5, the gasification furnace according to embodiments of the present invention comprises an outer shell 100, an inner shell 200, a nozzle 1, a lower shell 300, a cooler 9, a positioning member 11, and a gas guiding pipe 10.

The outer shell 100 is a pressure shell. An outer shell inlet is formed at a top of the outer shell 100, and an outer shell outlet is formed at a bottom of the outer shell 100. The inner shell 200 is disposed in and spaced apart from the outer shell 100 so as to define a space between the inner shell 200 and the outer shell 100. There are no special limitations on the mounting manner of the inner shell 200 within the outer shell 100. For example, the inner shell 200 may be hung on a bracket located outside the gasification furnace.

A gasification chamber is defined in the inner shell 200, and the internal pressure of the gasification chamber is substantially 0.1 MPa to 9.0 MPa. An inner shell inlet corresponding to the outer shell inlet is formed at a top of the inner shell 200, and an inner shell outlet corresponding to the outer shell outlet is formed at a bottom of the inner shell 200.

For example, the inner shell inlet and the outer shell inlet are aligned in an up and down direction, and the inner shell outlet and the outer shell outlet are aligned in an up and down direction.

The inner shell 200 is fabricated by a membrane wall having a cooling water inlet N2 and a cooling water outlet N3. Accordingly, water can be used to cool the inner shell 200 instead of the refractory brick in the outer shell 100, thus improving the temperature that can be withstood by the gasification chamber. For example, the temperature that can be withstood by the gasification chamber can reach 1400 degrees centigrade or higher. Therefore, the coal with a high ash fusion point can be used as a raw material to produce a crude coal gas containing carbon monoxide and hydrogen.

Advantageously, an inert gas may be supplied to the space defined between the inner shell 200 and the outer shell 100 by a separate pipe, thus preventing the gas produced in the gasification chamber from entering into the space and maintaining a pressure balance between the space and the gasification chamber.

The nozzle 1 is disposed at the tops of the outer shell 100 and the inner shell 200 so as to extend into the gasification chamber through the outer shell inlet and the inner shell inlet. In other words, the nozzle 1 may be mounted within the outer shell inlet and the inner shell inlet, and an upper end of the nozzle 1 is extended out of the outer shell 100 and a lower end of the nozzle 1 is extended into the gasification chamber. For example, the nozzle 1 may have three inlets N1*a*, N1*b*, N1*c*, which are used to inject the coal-water slurry and an oxidizer into the gasification chamber respectively.

The lower shell 300 is connected with a lower portion of the outer shell 100 and defines a slag exhausting chamber in the lower shell 300. A slag exhausting port 7 is formed at a bottom of the lower shell 300, and a lower portion of the lower shell 300 may be formed to have a cone shape. A gas discharging port N5 is formed in an upper portion of a side wall of the lower shell 300. The gasification chamber is communicated with the slag exhausting chamber via the outer shell outlet and the inner shell outlet, and consequently the high-temperature gas, produced by a combustion reaction of the coal-water slurry with the oxidizer injected into the gasification chamber through the nozzle 1, enters into the slag exhausting chamber via the outer shell outlet and the inner shell outlet together with an ash (including melted slag, unmelted slag and other solid materials).

The cooler 9 is connected with an outer bottom wall of the outer shell 100 around the outer shell outlet. Advantageously, the cooler 9 may be an annular plate formed with a cooling passage therein. A cooler water inlet and a cooler water outlet 91 communicated with the cooling passage are formed in the annular plate. The water is injected out of the cooler 9 from the cooler water outlet 91 for cooling the gas and the ash discharged from the gasification chamber. Advantageously, the cooler water outlet 91 is formed as an annular and flat slot extended along a circumferential direction of the annular plate. Accordingly, even if the annular plate is abraded by the injected water, it only causes the inner diameter of the annular plate to be enlarged, but the cooler water outlet 91 will not be affected, so that the pattern of water jet will be unchanged, which facilitates to use the coal with a high ash fusion point as the raw material and improves the reliability of the operation.

The positioning member 11 is disposed between the inner shell 200 and an inner bottom wall of the outer shell 100 for positioning the bottom of the inner shell 200.

The gas guiding pipe 10 defines an upper end connected with the cooler 9 and a lower end extended downward in the slag exhausting chamber. A cooling water passage is formed in a wall of the gas guiding pipe 10, and water inlets N4*a*, N4*b* and a water outlet 101 communicated with the cooling water passage are formed in the gas guiding pipe 10 respectively.

As shown in FIG. 1 and FIG. 4, a plurality of water outlets 101 are formed in an inner circumferential wall of the gas guiding pipe 10, and the water inlets N4*a*, N4*b* of the gas guiding pipe 10 can be connected with an external water source through the pipe of the lower shell 300. The water enters into the gas guiding pipe 10 via the pipe and the water inlets N4*a*, N4*b*, and then is injected into the interior of the gas guiding pipe 10, thus cooling the gas and the ash falling in the gas guiding pipe 10.

It should be understood that the water outlet 101 and the water inlets N4*a*, N4*b* of the gas guiding pipe 10 may be formed in the outer circumferential wall of the gas guiding pipe 10. In this case, the cooling water just cools the gas guiding pipe 10, but is not injected out of the inner circumferential wall of the gas guiding pipe 10 to contact the falling gas and ash directly.

It should be explained that, in the present invention, openings such as the slag discharging port, the gas discharging port and the water inlet should be understood broadly. By way of example and without limitation, each opening can be a predetermined length of corresponding pipe, and corresponding valves can be disposed on the pipe so as to control the opening to open or close. For example, the gas discharging port and the gas discharging pipe have the same meaning.

In one example of the present invention, as shown in FIG. 1 and FIG. 4, the cooler 9 and the gas guiding pipe 10 may be integrally formed, by way of example and without limitation, the cooler 9 and the gas guiding pipe 10 are formed as a cylinder having a circular opening in an upper end surface thereof. Accordingly, the cooler 9 and the gas guiding pipe 10 may share the water inlets N4*a*, N4*b*, and the cooling water passage in the cooler 9 is communicated with the cooling water passage in the gas guiding pipe 10, thus further simplifying structures of the cooler 9 and the gas guiding pipe 10.

As shown in FIG. 1, in this embodiment, the lower end of the gas guiding pipe 10 is extended below the liquid level of the cooling water in the lower shell 300. When the gas and ash in the gasification chamber fall into the gas guiding pipe 10, the gas is discharged out of the gasification furnace from the gas discharging port N5 formed in the upper portion of the lower shell 300 after passing through the cooling water in the lower shell 300, thus further lowering the temperature of the gas, while the ash falls into the cooling water in the lower portion of the lower shell 300 and is discharged out of the lower shell 300 from the slag discharging port 7.

With the gasification furnace according to embodiments of the present invention, the gasification chamber is formed by the inner shell 200 fabricated by a single membrane wall, the temperature in the gasification chamber can be improved so that the coal with a high ash fusion point can be used as a raw material to produce a gas, and it is convenient to manufacture, replace and maintain the inner shell 200. Moreover, the positioning member 11 disposed between the inner bottom wall of the outer shell 100 and the inner shell 200 is convenient to replace and has an ability of resisting gas erosion better than the refractory brick.

As shown in FIG. 1 and FIG. 5, in some embodiments of the present invention, the inner shell 200 comprises an upper header, a lower header and a plurality of cooling pipes. The upper header is annular so as to define the inner shell inlet. Similarly, the lower header is annular so as to define the inner shell outlet. By way of example and without limitation, the upper header and the lower header are annular pipes, so that they are easy to manufacture.

Two ends of each cooling pipe are connected with the upper and lower headers respectively, and a plurality of cooling pipes are extended side by side in the up and down direction. It should be noted that: the description "the cooling pipes are extended in the up and down direction" does not mean that every and each of the cooling pipes must be a straight pipe extended in a vertical direction, but means that each of the cooling pipes may be partially bent outwards in a radial direction, as shown in FIG. 1, but substantially extended in the up and down direction. Accordingly, it is more convenient to manufacture the inner shell 200 and to install in site, thus reducing the cost.

As shown in FIG. 1, the cooling water inlet N2 is positioned in a lower portion of the inner shell 200, and the cooling water outlet N3 is positioned in an upper portion of the inner shell 200. As described above, the cooling water entering into the inner shell 200 from the lower cooling water inlet N2 is changed into a mixture of water and a steam after heat exchange, and the mixture may be discharged out of the inner shell 200 from the upper cooling water outlet N3 according to the principle of the natural water circulation, thus facilitating the water circulation.

In one example of the present invention, as shown in FIG. 1, the outer shell 100 comprises an upper cover 2, a lower cover 4, and a straight cylinder 3 having two ends connected with the upper cover 2 and the lower cover 4 respectively. By way of example and without limitation, the upper cover 2, the lower cover 4 and the straight cylinder 3 may be welded together after being manufactured separately, so that the outer shell 100 has an oblong longitudinal section.

As shown in FIG. 1, the positioning member 11 comprises an annular trough 112 and an annular insertion plate 111. The annular trough 112 is mounted on the outer inner bottom wall of the outer shell 100 around the outer shell outlet, and defines an annular groove therein. An upper end of the annular insertion plate 111 is mounted on a bottom wall of the inner shell 200 around the inner shell outlet, and a lower end of the annular insertion plate 111 is inserted and fitted into the annular groove, thus positioning the bottom of the inner shell 200.

As shown in FIG. 1 and FIG. 4, in some embodiments of the present invention, advantageously, a plurality of water outlets 101 of the gas guiding pipe are formed in an inner circumferential wall of the gas guiding pipe 10 and distributed in the up and down direction as well as a circumferential direction of the gas guiding pipe 10. Accordingly, during the falling of the gas and the ash discharged from the gasification chamber, the gas and the ash are first cooled by the cooler 9, and then fall into the gas guiding pipe 10 and are cooled by the water injected from the water outlets 101 distributed in an entire length direction of the gas guiding pipe 10 as well as in the circumferential direction of the gas guiding pipe 10 in the inner circumferential wall of the gas guiding pipe 10, thus improving the cooling effect.

In some embodiments of the present invention, the cooler 9 is an annular plate, and an opening direction of the cooler water outlet 91 of the cooler 9 is oriented towards or away from a center axis of the annular plate in a horizontal direction. When the opening direction of the cooler water outlet 91 of the cooler 9 is oriented away from the center axis of the annular plate in the horizontal direction, the water injected from the cooler water outlet 91 of the cooler 9 may form an eddy, thus further improving the cooling effect. Alternatively, the cooler 9 is an annular plate, and the opening direction of the cooler water outlet 91 of the cooler 9 is inclined downward and oriented towards or away from the center axis of the annular plate.

Accordingly, according to embodiments of the present invention, different water jets may be formed by adjusting the opening direction of the cooler water outlet 91 of the cooler 9, thus adjusting the cooling effect of the gas and the ash.

The operation of the gasification furnace according to the embodiment shown in FIG. 1 will be simply described below.

A coal-water slurry and an oxidizer are injected into the gasification chamber through the nozzle 1, and the gasification reaction takes place in the gasification chamber. The reaction product contains a gas (including CO, $H_2$, $H_2O$, $CO_2$, $CH_4$ and so on), melted and unmelted carbon-containing ashes, and a small amount of other components coming with the raw fuel. The produced high-temperature gas and the ash pass downwards through the cooler 9 and the gas guiding pipe 10 so as to be cooled. Thus, the temperature of the gas and the ash is lowered, by way of example and without limitation, the temperature is quickly lowered from a temperature of above 1300 degrees centigrade so as to solidify most of the melted slag. The solidified melted slag, the unmelted solid materials and the gas enter into the water in the slag discharging chamber, and then the slag is discharged from the slag discharging port 7 and the gas is discharged from the gas discharging port N5 communicated with the gas discharging space after coming out of the water.

The gasification furnace according to another embodiment of the present invention will be described below with reference to FIG. 2.

Figure 2:
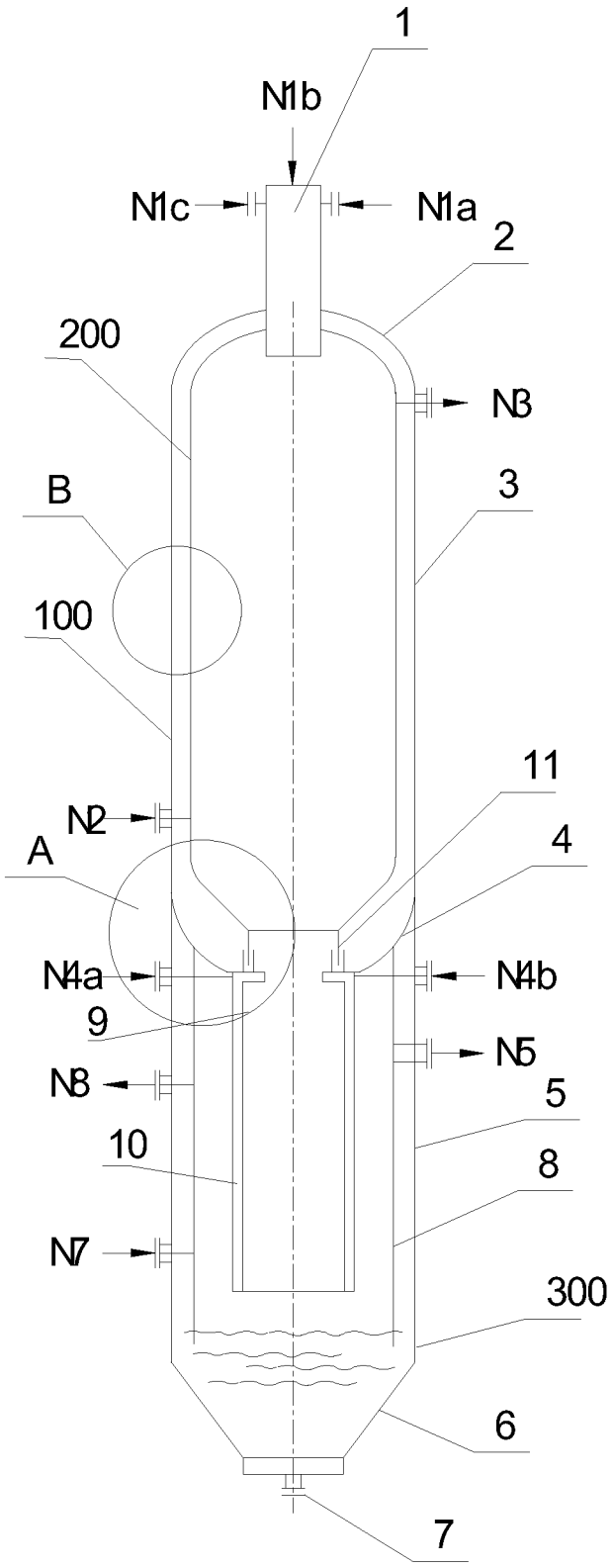
FIG. 2 is a schematic view of a gasification furnace according to another embodiment of the present invention.

As shown in FIG. 2, the gasification furnace according to the present embodiment of the present invention further comprises a cooling panel 8. For example, the cooling panel 8 may be cylindrical. The cooling panel 8 comprises a cooling panel water inlet N7, a cooling panel cooling panel water outlet N8, and a cooling panel passage communicated with the cooling panel water inlet N7 and the cooling panel cooling panel water outlet N8.

An upper end of the cooling panel 8 is connected with the outer bottom wall of the outer shell 100 and the cooling panel 8 is fitted over the gas guiding pipe 10 so as to define a gas discharging space between the cooling panel 8 and the gas guiding pipe 10. The gas discharging port N5 is communicated with an upper portion of the gas discharging space. For example, the gas discharging port N5 is communicated with the upper portion of the gas discharging space through the cooling panel 8.

In one example of the present invention, as shown in FIG. 2, a lower end of the cooling panel 8 is extended below the liquid level of the cooling water in the lower shell 300, and the lower end of the gas guiding pipe 10 is located above the liquid level of the cooling water in the lower shell 300 so as to prevent the gas from entering into the space between the cooling panel 8 and the lower shell 300.

As shown in FIG. 2, as described above, according to the principle of the natural water circulation, advantageously, the cooling panel water inlet N7 is located in a lower portion of the cooling panel 8, and the cooling panel water outlet N8 is located in an upper portion of the cooling panel 8.

Other structures of the gasification furnace according to the embodiment of the present invention shown in FIG. 2 may be the same as those described with reference to the above embodiments shown in FIG. 1, so that the detailed descriptions thereof will be omitted here.

According to this embodiment of the present invention, the ash from the gasification chamber falls into the cooling water in the lower shell 300, and the produced gas enters into the gas discharging space after leaving the gas guiding pipe 10 and moves upwards in the gas discharging space. During the upward movement, the gas can be further cooled by the cooling panel 8 and then discharged from the gas discharging port N5.

The operation of the gasification furnace according to embodiment shown in FIG. 2 will be simply described below.

A coal-water slurry and an oxidizer are injected into the gasification chamber through the nozzle 1. The produced high-temperature gas and the ash pass downwards through the cooler 9 and the gas guiding pipe 10 so as to be cooled. Thus, the temperature of the gas and the ash is lowered, by way of example and without limitation, the temperature is quickly lowered from a temperature of above 1300 degrees centigrade so as to solidify most of the melted slag. The solidified melted slag, the unmelted solid materials and the gas enter into the water in the slag discharging chamber, and then the slag is discharged from the slag discharging port 7, and the gas is discharged from the gas discharging port N5 after entering into the gas discharging space from the gas guiding pipe 10 and being cooled by the cooling panel 8.

The gasification furnace according to still another embodiment of the present invention will be described below with reference to FIG. 3.

Figure 3:
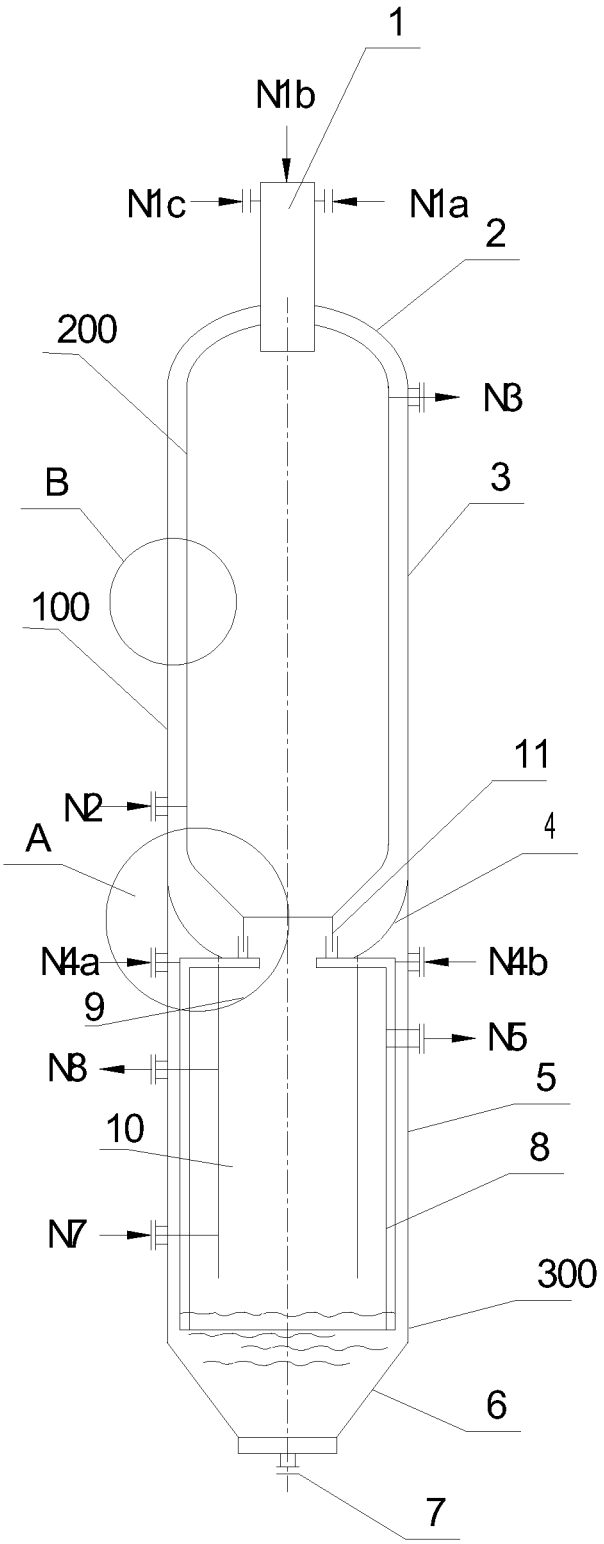
FIG. 3 is a schematic view of a gasification furnace according to still another embodiment of the present invention.

As shown in FIG. 3, the gasification furnace according to this embodiment of the present invention further comprises a cooling panel 8. For example, the cooling panel 8 may be cylindrical. The cooling panel 8 comprises a cooling panel water inlet N7, a cooling panel water outlet N8, and a cooling panel passage communicated with the cooling panel water inlet N7 and the cooling panel cooling panel water outlet N8.

An upper end of the cooling panel 8 is connected with the outer bottom wall of the outer shell 100 and the cooling panel 8 is fitted in the gas guiding pipe 10 so as to define a gas discharging space between the cooling panel 8 and the gas guiding pipe 10. The gas discharging port N5 is communicated with an upper portion of the gas discharging space. For example, a length of a gas discharging pipe (i.e. gas discharging port N5) passes through the gas guiding pipe 10, so that the gas discharging port N5 is communicated with the upper portion of the gas discharging space. It should be understood that, for example, because the cooling panel 8 is fitted in the gas guiding pipe 10, the upper end of the cooling panel 8 can be connected with the outer bottom wall of the outer shell 100 via a member such as a tension rod passing through the cooler 9.

In one example of the present invention, as shown in FIG. 3, the lower end of the gas guiding pipe 10 is extended below the liquid level of the cooling water in the lower shell 300, and a lower end of the cooling panel 8 is located above the liquid level of the cooling water in the lower shell 300.

In this embodiment of the present invention, the water outlet 101 of the gas guiding pipe 10 may be formed in the inner wall of the gas guiding pipe 10, or formed in the outer wall of the gas guiding pipe 10.

Other structures and operations of the gasification furnace shown in FIG. 3 may be the same as those shown in the above embodiments in FIG. 1 and FIG. 2, so the detailed descriptions thereof will be omitted here.

Reference throughout this specification to "an embodiment," "some embodiments," "one embodiment," "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment," "in an embodiment," "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present invention, and changes, alternatives, and modifications can be made in the embodiments without departing from spirit, principles and scope of the present invention.

What is claimed is:

1. A gasification furnace, comprising:

an outer shell having an outer shell inlet formed at a top of the outer shell and an outer shell outlet formed at a bottom of the outer shell;

an inner shell which is disposed in and spaced apart from the outer shell, defines a gasification chamber therein, has an inner shell inlet corresponding to the outer shell inlet and formed at a top of the inner shell, and an inner shell outlet corresponding to the outer shell outlet formed at a bottom of the inner shell, and is fabricated by a membrane wall having a cooling water inlet and a cooling water outlet;

a nozzle disposed at the tops of the outer shell and the inner shell so as to extend into the gasification chamber through the outer shell inlet and the inner shell inlet;

a lower shell connected with a lower portion of the outer shell, defining a slag exhausting chamber therein, and having a slag exhausting port formed at a bottom of the lower shell and a gas discharging port formed in an upper portion of a side wall of the lower shell, wherein the gasification chamber is communicated with the slag exhausting chamber via the outer shell outlet and the inner shell outlet;

a cooler connected with an outer bottom wall of the outer shell around the outer shell outlet, and having a cooling passage formed therein, a cooler water inlet, and a cooler water outlet;

a positioning member disposed between the inner shell and an inner bottom wall of the outer shell, the positioning member comprising:

an annular trough mounted on the inner bottom wall of the outer shell around the outer shell outlet and defining an annular groove; and an annular insertion plate defining an upper end mounted on a bottom wall of the inner shell around the inner shell outlet and a lower end inserted into the annular; and a gas guiding pipe defining an upper end connected with the cooler, and a lower end extended downward in the slag exhausting chamber, wherein the gas guiding pipe has a cooling water passage formed in a wall of the gas guiding pipe, a water inlet and a water outlet which are communicated with the cooling water passage respectively.

2. The gasification furnace according to claim 1, wherein the inner shell comprises:

an upper header being annular so as to define the inner shell inlet;

a lower header being annular so as to define the inner shell outlet; and a plurality of cooling pipes extended side by side in an up and down direction, wherein two ends of each cooling pipe are connected with the upper and lower headers respectively.

3. The gasification furnace according to claim 2, wherein each of the upper and lower headers is configured as an annular pipe.

4. The gasification furnace according to claim 1, wherein the cooling water inlet is positioned in a lower portion of the inner shell, and the cooling water outlet is positioned in an upper portion of the inner shell.

5. The gasification furnace according to claim 1, wherein the outer shell comprises:

an upper cover;

a lower cover; and a straight cylinder defining two ends connected with the upper cover and the lower cover respectively.

6. The gasification furnace according to claim 1, wherein the lower end of the gas guiding pipe is extended below a liquid level of cooling water in the lower shell.

7. The gasification furnace according to claim 1, wherein the cooler is an annular plate and the water outlet is configured as an annular and flat slot extended in a circumferential direction of the annular plate.

8. The gasification furnace according to claim 1, wherein the cooler is an annular plate, and an opening direction of the water outlet of the cooler is oriented towards or away from a center axis of the annular plate in a horizontal direction.

9. The gasification furnace according to claim 1, wherein the cooler is an annular plate, and an opening direction of the water outlet of the cooler is inclined downward and oriented towards or away from a center axis of the annular plate.

10. The gasification furnace according to claim 1, further comprising:

a cooling panel having a cooling panel passage, a cooling panel water inlet and a cooling panel water outlet which are communicated with the cooling panel passage respectively, wherein an upper end of the cooling panel is connected with the outer bottom wall of the outer shell, the cooling panel is fitted over the gas guiding pipe so as to define a gas discharging space therebetween, and the gas discharging port is communicated with an upper portion of the gas discharging space.

11. The gasification furnace according to claim 10, wherein a lower end of the cooling panel is located below the liquid level of the cooling water in the lower shell, and the lower end of the gas guiding pipe is located above the liquid level of the cooling water in the lower shell.

12. The gasification furnace according to claim 1, further comprising:

a cooling panel having a cooling panel passage, a cooling panel water inlet and a cooling panel water outlet which are communicated with the cooling panel passage respectively, wherein an upper end of the cooling panel is connected with the outer bottom wall of the outer shell, the cooling panel is fitted in the gas guiding pipe so as to define a gas discharging space therebetween, and the gas discharging port is communicated with an upper portion of the gas discharging space.

13. The gasification furnace according to claim 12, wherein a lower end of the cooling panel is located above the liquid level of the cooling water in the lower shell, and the lower end of the gas guiding pipe is located below the liquid level of the cooling water in the lower shell.

14. The gasification furnace according to claim 1, wherein a plurality of the water outlets of the gas guiding pipe are formed in an inner circumferential wall of the gas guiding pipe and distributed in an up and down direction and a circumferential direction of the gas guiding pipe.

15. The gasification furnace according to claim 1, wherein the cooler and the gas guiding pipe are integrally formed.

* * * * *